United States Patent [19]

Uesugi et al.

[11] Patent Number: 4,613,413

[45] Date of Patent: Sep. 23, 1986

[54] PROCESS FOR PRODUCING ALUMINUM SUPPORT FOR LITHOGRAPHIC PLATE

[75] Inventors: Akio Uesugi; Tsutomu Kakei; Makoto Takeuchi, all of Shizuoka, Japan

[73] Assignee: Fuji Photo Film Co., Ltd., Kanagawa, Japan

[21] Appl. No.: 612,171

[22] Filed: May 21, 1984

[30] Foreign Application Priority Data

May 19, 1983 [JP] Japan ..... 58-88082

[51] Int. Cl.[4] ..... C25D 11/16

[52] U.S. Cl. ..... 204/33

[58] Field of Search ..... 204/17, 28, 33, DIG. 10

[56] References Cited

U.S. PATENT DOCUMENTS

| | | | |
|---|---|---|---|
| 3,691,030 | 9/1972 | Stroszynski | 204/28 |
| 3,873,318 | 3/1975 | Sheasby | 204/28 |
| 4,324,841 | 4/1982 | Huang | 204/33 |
| 4,477,317 | 10/1984 | Chu | 204/33 |

*Primary Examiner*—T. M. Tufariello

*Attorney, Agent, or Firm*—Sughrue, Mion, Zinn, Macpeak & Seas

[57] ABSTRACT

A process for producing an aluminum support for a lithographic printing plate is described, which comprises jetting a high-pressure liquid from at least one nozzle at a high rate, joining the jetted stream with a slurry containing a fine powder of an abrasive spouted from at least one spout, and directing the resulting mixed stream to strike against a surface of an aluminum plate to carry out cleaning and sandblasting at the same time.

16 Claims, 2 Drawing Figures

FIG. 1
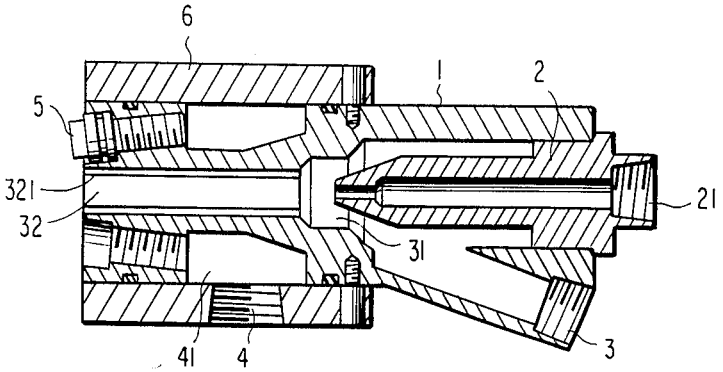
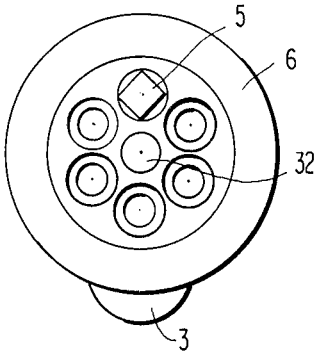
FIG. 2

PROCESS FOR PRODUCING ALUMINUM SUPPORT FOR LITHOGRAPHIC PLATE

FIELD OF THE INVENTION

The present invention relates to a process for producing a support for a lithographic printing plate and, particularly, to a process for roughening a surface of an aluminum plate used as a support.

BACKGROUND OF THE INVENTION

Hitherto, as lithographic printing plates, so-called Presensitized Plates have been used, wherein a light-sensitive composition is applied onto an aluminum plate to form a light-sensitive layer. In the above-described aluminum plate, a rough surface is formed by a process suitably selected from a mechanical roughening process such as ball graining, wire graining, brush graining, liquid honing, etc., an electro-chemical roughening process such as electrolytic graining, etc., a chemical roughening process and a combination of two or more of them, by which a satin finish is obtained on the surface. Then, it is etched, if necessary, with an aqueous solution of acid or alkali and subjected to anodic oxidation treatment. Thereafter, it is subjected, if necessary, to a treatment for providing a hydrophilic property to produce a support for a lithographic printing plate. On the treated surface, a light-sensitive layer is provided to produce a light-sensitive lithographic printing plate, namely, Presensitized Plate. This Presensitized Plate is then subjected to exposure to light, development, retouching, gumming, etc. to produce a printing plate, which is then placed on a printing apparatus to carry out printing.

Although there are many processes for treating the surface of an aluminium plate, known processes have various faults. For instance, in the case of ball graining, there are problems in that high skills are required for selection of the kind (material) or the size of balls, control of water in carrying out abrasion, determination of abrasion time and evaluation of the finished surface due to a batch processing, and productivity is very inferior. In the case of wire graining, the roughness of the resulting surface of the aluminum plate is non-uniform. In case of brush graining, high roughness is not obtained on the treated surface, and scattering is easily formed on the coarse face by the wear of the abrasion brush used. Further, there are problems that the surface of aluminum is scratched by the strong friction between the brush and the abrasive so as to form many sharp projections like molding projections, by which the light-sensitive layer to be removed by development of the Presensitized Plate remains to cause stains on the plate face, or scratches are easily formed on the surface by rubbing of the treated surface (rough surface) in the case of handling the aluminum plate. In the case of liquid honing, since a slurry liquid containing a fine abrasive powder dispersed in the liquid is sprayed at a high rate by compressed air, the fine abrasive powder easily sticks into the surface of aluminum, to thereby form projections; further in this process, there are problems in that the roughness of the surface cannot be sufficiently increased because the impulsive force of the slurry liquid against the surface of aluminum is small and that the setting nozzle wears significantly because the slurry liquid is jetted at a high rate. In the case of electrochemical roughening, it is necessary to carry out minute control of the electrolysis condition in order to keep the treated surface at a constant roughness, and the consumption of electric power is rather large; moreover, disposal of waste liquor containing Al ions accumulated in the electrolyte requires great expense. In the case of chemical roughening, the time required for treatment is relatively long and, consequently, it is not suitable for mass production. Further, great expense is required for disposal of waste liquor as in the case of the electrochemical process.

SUMMARY OF THE INVENTION

As a result of many studies to overcome the abovedescribed problems of the noted processes the present invention has now been accomplished.

Accordingly, an object of the present invention is to provide a process for producing an aluminum support for a lithographic printing plate which comprises jetting a high-pressure liquid at a high rate from at least one nozzle, joining the jetted stream to a slurry containing a fine powder of an abrasive spouted from at least one spout, directing the mixed stream to strike against a surface of an aluminum plate, and, if desired, thereafter carrying out an anodic oxidation treatment.

BRIEF DESCRIPTION OF THE DRAWINGS

FIG. 1 is a cross-sectional view of an apparatus which is used as one embodiment in the process of the present invention, and FIG. 2 is a front view of the apparatus shown in FIG. 1.

DETAILED DESCRIPTION OF THE INVENTION

As raw materials for the aluminum plates used in the present invention, pure aluminum and aluminum alloy may be used. Examples of the latter include alloys composed of aluminum as a main component and very small amounts of silicon, copper, iron, manganese, magnesium, chromium, zinc, lead, bismuth, nickel, etc. In any case, the aluminum is preferred to have a purity of 99.0% by weight or more.

An aluminum plate composed of the above described raw materials used as a lithographic plate generally has a rectangular shape in relation to printers. However, in the present invention, it is belt-shaped running web till it is cut into rectangular shape, in case of mass production, and it is handled by rewinding. The thickness of the aluminum plate can practically be in the range of from 0.1 to 0.5 mm and is suitably selected according to tensile strength, yield strength, elongation, flexural strength, etc., required for the particular application of lithographic printing the plate to a printer.

On the other hand, the apparatus for striking the abrasive slurry against the surface of the above described aluminum plate in order to form a rough surface comprises a nozzle communicating with a feed part for the high-pressure liquid and a spout communicating with a feed source of the abrasive slurry, wherein the nozzle and the spout are arranged so that the stream of the slurry spouted from the latter is joined with the stream of the high-pressure liquid jetted from the former. In the case of a plurality of nozzles, they may be provided around the latter spout.

FIG. 1 is a cross-sectional view of an apparatus having nozzles for jetting a high-pressure liquid (water) and also spouting a slurry, which can be used as a specific one embodiment in the process of the present invention.

1 is a main body having nozzles for spouting a slurry at high rate; 2 is an inlet of a high-pressure air; 3 is a slurry inlet which is constructed by a part of the main body 1; 4 is an inlet of a high-pressure water; 5 is jetting nozzles of the high-pressure water provided concentrically at the front portion of the main body 1; and 6 is a member which covers the main body 1 and constitutes a passage of the high-pressure water.

The high-pressure water is introduced into the apparatus from the inlet 4 and jetted from the nozzles 5 via the passage 41. As shown in FIG. 1, nozzles 5 are composed of a plurality of nozzles which are concentrically provided at the front portion of the main body. Each nozzle 5 has each passage 41 and the high-pressure water flows into each nozzle from the inlet 4 and is jetted from each nozzle.

On the other hand, the slurry is fed from the inlet 3, flown into a reservoir 31, accelerated by air (or liquid) jetted from the nozzle 2 and spouted from a spout 32. The slurry passes through the spout 32 at a very high rate and the abrasion of the inner wall thereof is remarkable. Therefore, the inner wall of the spout 32 is covered with an abrasion-resistant material 321.

FIG. 2 is a front view of the apparatus shown in FIG. 1. The nozzles 5 face the slurry stream spouted from the center portion at a high rate so as to join the high-pressure water stream jetted from the nozzles 5 and the slurry stream from the spout 32. The jointing portions of the water streams and the slurry steam may be the same or different.

The above-described feed part for the high-pressure liquid may have various embodiments. For example, it may be a container containing a liquid kept at a high liquid pressure, or it may be a system comprising a container containing a liquid at an atmospheric pressure and a pressure spouting pump communicated with the container. In any case, it is necessary that the liquid be jetted from the nozzle(s) at a flow rate of 31 to 140 m/second, preferably 77 to 99 m/second. The liquid pressure causing such a flow rate can be calculated as 5 to 100 kg/cm$^2$, preferably 30 to 50 kg/cm$^2$. The liquid may also contain, if desired, acids or alkalis.

On the other hand, the feed part for the abrasive slurry comprises a container for accumulating the abrasive slurry and a means for stirring the slurry so as not to allow precipitation of the solids. The means for stirring in order to prevent precipitation of solids may be a propeller stirrer inserted in the container or may be a structure for circulating the slurry. By constantly moving the slurry, precipitation of the solids can be prevented. The container communicates with the spout by means of a tube, for example, a pressure-resisting hose, and a pump for spouting the slurry is provided in the middle of this tube. The feed part for the abrasive slurry having the above described construction feeds the slurry in a stirred state to the nozzle through the conduit tube by means of the pump, to spout the slurry from the spout. It is preferred that the spouting rate of the slurry be from 2 to 25 m/second.

The slurry is composed of water and a fine powder of an abrasive material. The fine powder abrasive is generally used in an amount of from 5 to 80% by weight, and is preferably used in an amount of 30 to 50% by weight, based on the total weight of the slurry. To the slurry, acids or alkalis can be added is desired. Useful abrasives include diamond, quartz, flint, granite, alundum, silica, diatom, sand, emery, garnet, talc, pumice, dolomite, magnesium oxide, etc. Those abrasives are used in a suitable particle size, for example, #20 to #4000, preferably #150 to #360, most preferably #180 to #220, which are the mean value according to JIS Z 8801-1956.

The reasons for including acids or alkalis in the liquid and/or slurry are that mechanical sandblasting and chemical sandblasting can be simultaneously carried out and also chemical sandblasting and chemical cleaning can be simultaneously carried out.

According to the present invention, the stream of the slurry is accelerated by the stream of the high-pressure liquid to strike against the surface of the aluminum plate. Preferably, the striking against the surface of the aluminum plate is carried out at an angle of a range from 15° to 165°.

In the case of using an aluminum plate having a large width, the treatment may be carried out by putting a plurality of the above-described apparatus side by side corresponding to the width of the aluminum plate. In this case, it is necessary to control the striking force in each apparatus so as to uniform over all of the width direction.

On the surface of the resulting aluminum support, an anodic oxidation film can be formed. When an electric current is applied using the aluminum plate as an anode in an aqueous solution or a nonaqueous solution of sulfuric acid, phosphoric acid, chromic acid, oxalic acid, sulfamic acid, benzenesulfonic acid or a combination of two or more thereof as an electrolyte, it is possible to form an anodic oxidation film on the surface of the aluminum plate. The processing conditions for anodic oxidation are not particularly limited, because it depends upon the electrolyte used, but it is generally preferred to use the conditions of a concentration of the electrolyte of from 1 to 80% by weight, a liquid temperature of from 5° to 70° C., a current density of from 0.5 to 60 amperes/dm$^2$, an electric voltage of from 1 to 100 V, and an electrolysis time of from 30 seconds to 50 minutes.

According to the present invention, since the slurry liquid containing an abrasive is accelerated by the high-pressure liquid to strike against the surface of an aluminum plate for a lithographic printing plate, the following beneficial effects are obtained. Namely, since a large impulsive force is applied to the aluminum plate, a processing hardening phenomenon occurs on the surface of aluminum and projections are removed by the high-pressure liquid, by which a surface which is difficult to scratch is formed. Further, it is possible to increase the average surface roughness, and printing plates having excellent printing durability can be produced because the surface becomes hard by the processing hardening phenomenon. Further, productivity is excellent and it is thus possible to reduce cost. In the process of the present invention, since a conflux of the stream of the slurry and the stream of the high-pressure liquid is allowed to strike against the aluminum plate, a liquid stream composed of parts having a higher concentration of the abrasive and parts having a lower concentration of the abrasive is formed, and thus a roughening function by the former and a cleaning function by the latter are combined. Accordingly, since the abrasive remaining in the surface texture formed by the former function can be completely removed by the latter function, Presensitized Plates obtained by these functions are excellent in "performances of staining" and "printing durability (press life)". Further, in case of using the liquid stream having such a construction, the parts having a low concentration of the abrasive have also a very high flow rate, they have a considerable impulsive force themselves and they can suitably remove the projections formed by the roughening function. Accordingly, it is possible to remarkably reduce the occurrence of scratches formed by friction between surfaces of aluminum plates, which is very different from the case of aluminum plates in a state wherein projections remain.

In the following, the present invention is illustrated in detail by reference to the following examples.

EXAMPLE 1

A pumice-water slurry containing suspended pumice having an average particle size of 70μ was allowed to join with a water stream jetted from a nozzle at a pressure of 50 kg/cm$^2$, and the mixed stream was allowed to strike against a surface of a JIS 1050 aluminum plate at an angle of 30° to form a rough surface. The striking was carried out uniformly over all of the surface of the aluminum plate. The average surface roughness of the resulting aluminum plate was 0.5μ. When the surface was observed by an electron microscope, there were no projection and no abrasive remained. Further, the distance between hill crest parts of the surface texture was long as compared to the brush grained aluminum plate, and the surface texture had a comparatively simple shape having deep valley parts.

This aluminum plate was then dipped in a 15% by weight aqueous solution of sulfuric acid (temperature: 25° C.) and it was subjected to anodic oxidation treatment by sending a direct current of 22 V at an electrode interval of 150 mm for 60 seconds. It was then dipped in a 2% (by weight) aqueous solution of sodium silicate JIS No. 3 (solution temperature: 70° C.) for 30 seconds, followed by washing with water and drying. Then, p-toluene-sulfonic acid salt of a 1:1 condensation product of p-diazodiphenylamine and formaldehyde was applied as a light-sensitive component so as to result in a dry thickness of 1.8 g/m$^2$, followed by drying.

After the lithographic printing plate produced as described above was exposed to light and developed, it was mounted on the printer "KOR-D" produced by Heidelberg Co. (west Germany) to carry out printing. As a result, it was excellent in its performance of preventing stains on the surface and its performance of preventing scratches, and it had such good printing durability that more than 100,000 prints could be obtained.

EXAMPLE 2

A pumice-water slurry containing suspended pumice having an average particle size of 200μ was allowed to join with a water stream jetted from a nozzle at a pressure of 20 kg/cm$^2$, and the resulting mixed stream was allowed to strike against a surface of an aluminum sheet as described in Example 1 at an angle of 30°. Likewise, a slurry containing pumice having an average particle size of 40μ was allowed to join with a water stream jetted from a nozzle at a pressure of 50 kg/cm$^2$, and the mixed stream was allowed to strike against the surface of the aluminum plate at an angle of 90° (perpendicular) to form a uniform rough surface having an average surface roughness of 0.7μ. When the surface of the resulting aluminum plate was observed by an electron microscope as in Example 1, there were no projections and scarcely any pumice remained on the surface. Further, the surface had a texture wherein deep valley parts of a comparatively long period and shallow valley parts of a comparatively short period were combined.

Then, this aluminum plate was dipped in a 20% by weight aqueous solution of phosphoric acid (liquid temperature: 30° C.), and it was subjected to an anodic oxidation treatment of a direct current of 45 volts at an electrode interval of 100 mm for 70 seconds. After it was washed with water and dried, an o-quinonediazide composition was applied as a light-sensitive component, so as to result in a dry thickness of 2.5 g/m$^2$, followed by drying to obtain a lithographic printing plate.

After the lithographic printing plate produced as described above was exposed to light and developed, it was mounted on the printer "KOR-D" produced by Heidelberg Co. (West Germany) to carry out printing. As the result, it was excellent in its performance of preventing stains on the surface and its performance of preventing scratches, and it produced 150,000 prints which were excellent.

EXAMPLE 3

A pumice-water slurry containing suspended pumice having an average particle size of 100μ was allowed to join with a water stream spouted from a nozzle at a pressure of 40 kg/cm$^2$, and the resulting mixed stream was allowed to strike against a surface of a JIS 1050 aluminum plate at an angle of 45° to form a rough surface. The striking was carried out uniformly all over the surface of the aluminum plate. An average surface roughness of the resulting aluminum plate was 0.5μ.

This aluminum plate was then dipped in a 15% by weight aqueous solution of sulfuric acid (temperature 25° C.) and it was subjected to an anodic oxidation treatment of a direct current of 22 V at an electrode interval of 150 mm for 60 seconds. It was then dipped in a 2% by weight aqueous solution of sodium silicate JIS No. 3 (solution temperature: 70° C.) for 30 seconds, followed by washing with water and drying. Then, p-toluenesulfonic acid salt of a 1:1 condensation product of p-diazodiphenylamine and formaldehyde was applied as a light-sensitive component so as to result in a dry thickness of 1.8 g/m$^2$, followed by drying.

After the lithographic printing plate produced as described above was exposed to light and developed, it was mounted on the printer "KOR-D" produced by Heidelberg Co. (West Germany) to carry out printing. As the result, it was excellent in its performance of preventing stains on the surface and its performance of preventing scratches, and it had such good printing durability that more than 200,000 prints could be obtained.

EXAMPLE 4

A pumice-water slurry containing suspended pumice having an average particle size of 70μ was allowed to join with a water stream spouted from a nozzle at a pressure of 40 kg/cm$^2$, and the resulting mixed stream was allowed to strike against a surface of a JIS 1050 aluminum plate at an angle of 45° C. Similarly, the same pumice-water slurry was allowed to join with a water stream spouted from the nozzle at a pressure of 40 kg/cm$^2$, and the resulting mixed stream was allowed to strike against the surface of the above aluminum plate at an angle of 135° to form a rough surface. An average surface roughness of the resulting aluminum plate was 0.5μ.

The aluminum plate was desmatted with a 3% by weight aqueous solution of sodium aluminate at 60° C.

This aluminum plate was then dipped in a 20% by weight aqueous solution of sulfuric acid and it was subjected to an anodic oxidation treatment of a current density of 2 A/dm$^2$ for 2 minutes. It was then treated a 3% by weight aqueous solution of potassium silicate at 70° C. for 1 minute, followed by washing with water and drying. Then, p-toluenesulfonic acid salt of a 1:1 condensation product of p-diazodiphenylamine and formaldehyde was applied as a light-sensitive component so as to result in a dry thickness of 1.8 g/m$^2$, followed by drying.

After the lithographic printing plate produced ad described above was exposed to light and developed, it was mounted on the printer "KOR-D" produced by Heidelberg Co. (West Germany) to carry out printing. As the result, it was excellent in water-ink balance and its performance of preventing stains on the surface, and it had such good printing durability that more than 150,000 prints could be obtained.

While the invention has been described in detail and with reference to specific embodiments thereof, it will be apparent to one skilled in the art that various changes and modifications can be made therein without departing from the spirit and scope thereof.

What is claimed is:

1. A process for producing an aluminum support for a lithographic printing plate which comprises jetting a high-pressure liquid from at least one nozzle at a high rate, joining the jetted stream with a slurry containing a fine powder of an abrasive spouted from at least one spout, and directing the resulting mixed stream to strike against a surface of an aluminum plate to carry out cleaning and sandblasting at the same time.

2. A process for producing an aluminum support for a lithographic printing plate which comprises jetting a high-pressure liquid from at least one nozzle at a high rate, joining the jetted stream to a slurry containing a fine powder of an abrasive spouted from at least one spout, directing the resulting mixed stream to strike against a surface of an aluminum plate to carry out cleaning and sandblasting, and thereafter carrying out an anodic oxidation treatment.

3. A process for producing an aluminum support for a lithographic printing plate as in claim 1 or 2, wherein said high-pressure liquid contains acids or alkalis,

4. A process for producing an aluminum support for a lithographic printing plate as in claim 1, 2, wherein said slurry contains acids or alkalis.

5. A process for producing an aluminum support for a lithographic printing plate as in claim 1, wherein the high-pressure liquid is jetted from said at least one nozzle at a flow rate of 31 to 140 m/second and the slurry is spouted from said at least one spout at a flow rate of 2 to 25 m/second.

6. A process for producing an aluminum support for a lithographic printing plate as in claim 2, wherein the high-pressure liquid is jetted from said at least one nozzle at a flow rate of 31 to 140 m/second and the slurry is spouted from said at least one spout at a flow rate of 2 to 25 m/second.

7. A process for producing an aluminum support for a lithographic printing plate as in claim 1, wherein the slurry containing a fine powder of an abrasive contains from 5 to 80% by weight fine powder, based on the total weight of the slurry.

8. A process for producing an aluminum support for a lithographic printing plate as in claim 2, wherein the slurry containing a fine powder of an abrasive contains from 5 to 80% by weight fine powder, based on the total weight of the slurry.

9. A process for producing an aluminum support for a lithographic printing plate as in claim 1, wherein the slurry containing a fine powder of an abrasive contains from 30 to 50% by weight fine powder, based on the total weight of the slurry.

10. A process for producing an aluminum support for a lithographic printing plate as in claim 2, wherein the slurry containing a fine powder of an abrasive contains from 30 to 50% by weight fine powder, based on the total weight of the slurry.

11. A process for producing an aluminum support for a lithographic printing plate as in claim 2, wherein the conditions of carrying out the anodic oxidation treatment are a concentration of electrolyte of from 1 to 80% by weight, a liquid temperature of from 5° to 70° C., a current density of from 0.5 to 60 amperes/dm$^2$, an electric voltage of from 1 to 100 V, and an electrolysis time of from 30 seconds to 50 minutes.

12. A process for producing an aluminum support for a lithographic printing plate as in claim 3, wherein said slurry contains acids or alkalis.

13. A process for producing a support for a lithographic printing plate which comprises jetting a high-pressure liquid from at least one nozzle at a high rate, joining the jetted stream with a slurry containing a fine powder of an abrasive spouted from at least one spout, and directing the resulting mixed stream to strike against a surface of an aluminum plate, the improvement comprising forming at least two mixed streams having different angle of striking and particle size or the like of the abrasive and successively jetting the mixed streams against a surface of an aluminum support to form the desired rough surface thereon.

14. A process for producing a support for a lithographic printing plate which comprises jetting a high-pressure liquid from at least one nozzle at a high rate, joining the jetted stream with a slurry containing a fine powder of an abrasive spouted from at least one spout, and directing the resulting mixed stream to strike against a surface of an aluminum plate, the improvement comprising forming at least two mixed streams having different angle of striking and particle size of the abrasive, successively jetting the mixed streams against a surface of an aluminum support to form the desired rough surface thereon and then subjecting an anodic oxidation treatment to the surface.

15. A process for producing a support for a lithographic printing plate which comprises jetting a high-pressure liquid from at least one nozzle at a high rate, joining the jetted stream with a slurry containing a fine powder of an abrasive spouted from at least one spout, and directing the resulting mixed stream to strike against a surface of an aluminum plate, the improvement comprising forming at least two mixed streams having different angle of striking and particle size of the abrasive, successively jetting the mixed streams against a surface of an aluminum support to form the desired rough surface thereon and then subjecting a chemical etching treatment to the surface.

16. An aluminum support for a lithographic printing plate produced by the process of claim 1 or 2.

* * * * *